US008481957B2

(12) United States Patent
Guerard et al.

(10) Patent No.: US 8,481,957 B2
(45) Date of Patent: Jul. 9, 2013

(54) IONIZING RADIATION DETECTOR

(75) Inventors: Bruno Guerard, Vinay (FR); Jean-Claude Buffet, Laval (FR)

(73) Assignee: Institut Max Von Lau-Paul Langevin, Grenoble Cedex (FR)

( * ) Notice: Subject to any disclaimer, the term of this patent is extended or adjusted under 35 U.S.C. 154(b) by 153 days.

(21) Appl. No.: 13/038,915

(22) Filed: Mar. 2, 2011

(65) Prior Publication Data

US 2011/0215251 A1 Sep. 8, 2011

(30) Foreign Application Priority Data

Mar. 2, 2010 (FR) ..... 10 51502
Mar. 1, 2011 (EP) ..... 11156361

(51) Int. Cl.
*H01J 47/02* (2006.01)

(52) U.S. Cl.
USPC ..... 250/385.1; 250/374

(58) Field of Classification Search
USPC ..... 250/374, 375, 385.1, 389
See application file for complete search history.

(56) References Cited

U.S. PATENT DOCUMENTS

| | | | | |
|---|---|---|---|---|
| 4,447,727 | A | 5/1984 | Friesenhahn | |
| 5,071,381 | A | 12/1991 | Schieber | |
| 5,734,689 | A * | 3/1998 | Copeland et al. | 376/153 |
| 7,714,297 | B2 * | 5/2010 | Morris et al. | 250/393 |
| 2005/0205798 | A1 * | 9/2005 | Downing et al. | 250/390.11 |
| 2005/0258373 | A1 * | 11/2005 | Lacy | 250/390.01 |
| 2010/0012851 | A1 | 1/2010 | Bolotnikov et al. | |

FOREIGN PATENT DOCUMENTS

| | | | |
|---|---|---|---|
| DE | 19907042 | A1 | 8/2000 |
| FR | 943262 | A | 3/1949 |

OTHER PUBLICATIONS

Kliauga et al., "A Multi-Element Proportional Counter for Radiation Protection Measurements", Health Physics, vol. 57, No. 4, pp. 631-636, Oct. 1989.

French Search Report dated Oct. 26, 2010 for counterpart French Application No. FR 1051502.

* cited by examiner

*Primary Examiner* — Casey Bryant
(74) *Attorney, Agent, or Firm* — Howard IP Law Group, PC

(57) ABSTRACT

An ionizing radiation detector has conductive tubes arranged in parallel and containing a pressurized gas mixture, a conductive wire being pulled tight at the center of each tube and capable of being biased with respect thereto. Each tube is divided into isolated longitudinal sections. All the tube sections of a same transverse slice are electrically connected. Each group of sections of a same slice includes means for being connected to an elementary detector, wherein each slice is formed of a grid of blades.

16 Claims, 3 Drawing Sheets

IONIZING RADIATION DETECTOR

CROSS-REFERENCE TO RELATED APPLICATIONS

This application claims the benefit, under 35 U.S.C. §119, of French Application No. 10/51502, filed Mar. 2, 2010, and European Patent Application No. 11156361.5, filed Mar. 1, 2011, the entire disclosures of which are incorporated herein by reference in their entireties.

FIELD OF INVENTION

The present invention relates to the field of particle or ionizing radiation detectors, and in particular of neutron, γ or X-ray detectors.

BACKGROUND

FIG. 1 schematically shows a conventional structure of a detector sensitive to ionizing radiation. Such a detector comprises a conductive tube 1 filled with a gas mixture, sealed at its ends by isolating plugs 3. A conductive wire 5 having its ends crossing plugs 3 in an air-tight fashion, is pulled tight at the center of tube 1 by a spring 7 located within the tube. A positive electric voltage applied to wire 5 by a measurement circuit 9 enables an electric field to be defined within the tube, which encourages the drift and amplification of electrons generated by the passing of the ionizing radiation.

The gas mixture contained in the tube is chosen such that it is ionized by the particles to be detected, either directly, or after conversion into ionizing particles. For example, for neutron detection, a mixture of $CF_4$ and of $^3He$ (helium-3) in which $^3He$ behaves as a converter and $CF_4$ as a gas for stopping the two ionizing particles (proton and triton) emitted after the capture of a neutron by a $^3He$ atom may be used.

A so-called charge division process is currently used to measure the position of the impact along the tube. The wire is then resistive. The measurement circuit comprises read electronics enabling to measure the charge signal amplitude at each end of the wire. This detection method is always complex. Another so-called "counting" operating mode uses electronics based on the comparison of the signal measured at a single end of the wire with a reference voltage. This detection mode is generally inaccurate in its current implementations.

The uniformity of the detector response is affected by the inaccuracy of the wire centering inside of the tube, and such a centering is difficult to achieve. The difficulty of centering wire 5 limits the maximum amplification gain with which the detector can operate, which has direct consequences upon the detector performance (energy and position resolution).

An ionizing radiation detector is conventionally formed of several elementary detectors having juxtaposed tubes. The operation of a detector depends on the quality and on the pressure of the gas mixture that it contains. Furthermore, when several detectors must be used together with a certain minimum space between tubes, which is typically 10 millimeters (mm), it is difficult to ensure the continuity of the electromagnetic field shielding between the tube sheet and measurement circuit 9 without exceeding the external diameter of the tube, which results in creating dead spaces between detectors, thus resulting in a loss of sensitivity of the assembly.

SUMMARY

An embodiment of the present invention provides an assembly of detectors sensitive to ionizing radiations which is simple and inexpensive to implement.

An embodiment of the present invention provides an ionizing radiation detector particularly adapted to the use of thin layers of a conversion material configured for generating charged particles.

An embodiment of the present invention provides a detector capable of detecting the presence or the absence of an ionizing radiation, with or without locating the point of conversion of said radiation.

An embodiment of the present invention provides an ionizing radiation detector comprising a plurality of conductive tubes arranged in parallel and containing a gas mixture, and a conductive wire pulled tight at the center of each tube and capable of being biased with respect thereto, wherein each tube is divided into electrically isolated longitudinal sections, all the tube sections of a same transverse slice being formed of a grid of electrically connected blades and each group of sections of a same slice comprising means for being connected to a first detection circuit.

According to one embodiment, the grid of blades of each slice is connected to a frame.

According to an embodiment, each blade is coated with a layer containing a radiation conversion product configured for generating ions as a response to an ionizing radiation.

According to an embodiment, the conversion product is boron-10.

According to an embodiment, the gas mixture is a pressurized gas mixture comprising $BF_3$.

According to an embodiment, the blades are formed of aluminum.

According to an embodiment, a first group of blades of the grid comprises a plurality of slots which cooperate with a plurality of slots of a second group of blades of the grid orthogonal with respect to said first group.

According to an embodiment, the detection circuit comprises a plurality of resistors coupled in series between first and second amplifiers, wherein the nodes between the resistors are coupled to the connection means of respective slices.

According to an embodiment, each of the tubes comprises means for connecting the conductive wire of the tube to a second detection circuit.

According to an embodiment, the conductive wires of a group of the tubes are coupled together.

According to an embodiment, the second detection circuit comprises a plurality of resistors coupled in series between third and fourth amplifiers, wherein the nodes between the resistors are coupled to the connection means of respective tubes or groups of tubes.

According to an embodiment, the detector is configured to detect neutrons.

According to a further aspect of the present invention, there is provided an apparatus for detecting ionizing radiation comprising a plurality of the detectors, positioned side by side.

According to an embodiment, each of the plurality of detectors is positioned in a corresponding one of a series of chambers forming a segment of a cylinder.

The foregoing and other features, and advantages of the present invention will be discussed in detail in the following non-limiting description of specific embodiments in connection with the accompanying drawings.

BRIEF DESCRIPTION OF THE DRAWINGS

Understanding of the present invention will be facilitated by consideration of the following detailed description of the exemplary embodiments of the present invention taken in conjunction with the accompanying drawings, in which like numerals refer to like parts and in which.

DETAILED DESCRIPTION

Figure 1:
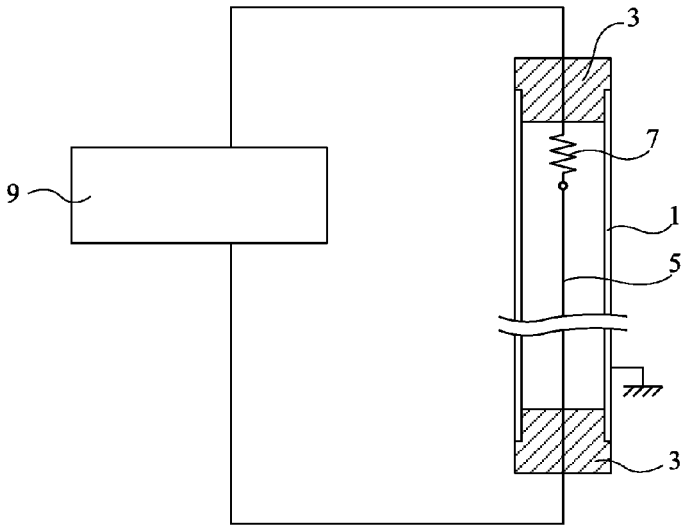
Fig 1 (PRIOR ART)
FIG. 1, previously described, schematically illustrates an element of a conventional radiation detector.
Figure 2:
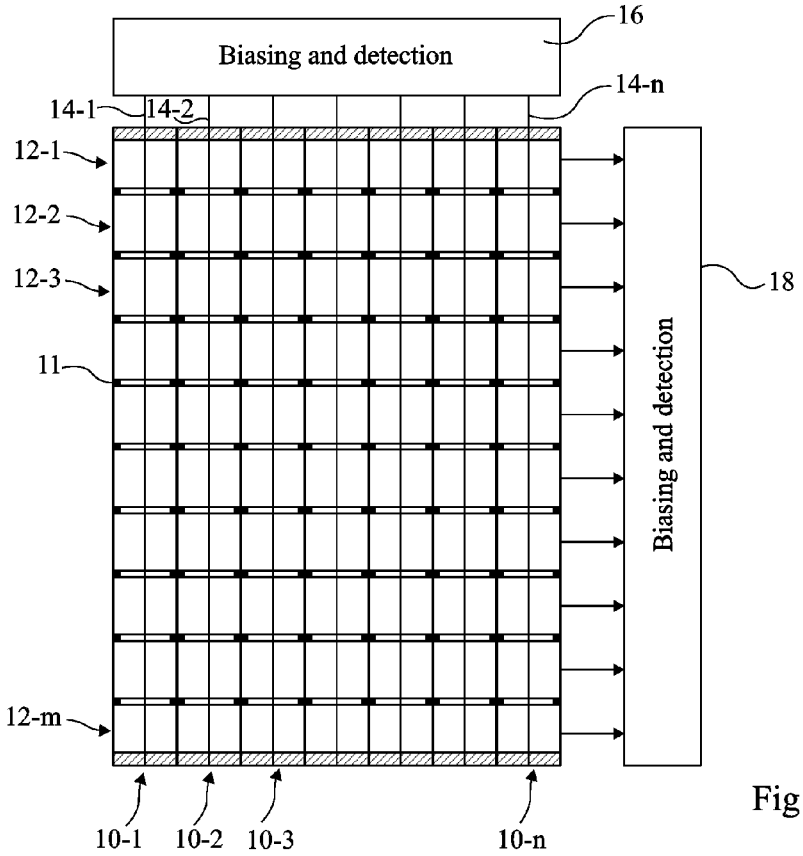
FIG. 2 schematically illustrates a front view of an ionizing radiation detector according to an embodiment of the present invention.

As shown in FIG. 2, an ionizing radiation detector comprises a parallel assembly of tubes 10-1, 10-2, 10-3, . . . , **10-*n*, each tube 10-1, 10-2, . . . 10-*n*, being formed of an assembly of stacked sections or tube elements 12-1, 12-2, 12-3, . . . , 12-*m* electrically isolated by isolators 11 or gaps. Each tube 10-1, 10-2, . . . , 10-*n* is crossed by a conductive element 14-1, 14-2 . . . 14-*n*, respectively. This conductive element 14-1, 14-2, . . . , 14-*n* may, for example, take the form of a wire or, as will be seen hereafter, of a thin strip. The wires 14-1, 14-2, . . . , 14-*n* are connected to a biasing and detection circuit 16, and all the tube elements or sections 12-1, 12-2, . . . , 12-*m* corresponding to a same slice (a grid) are connected to a biasing and detection circuit 18. Thus, the structure may be considered as formed of an assembly of cells 12-*ijk*, with i being between 1 and n, j being between 1 and m, and k being between 1 and I, I being the number of tubes in the direction perpendicular to the plane of the drawing. When an ionizing radiation interacts at the level of one of the cells 12-*ijk*, a gas contained in the cell 12-*ijk* is ionized and this ionization provides an electric signal on the central conductor 14-1, 14-2, . . . , 14-*n***, and on the tube wall. An x, y, and z indication of the location where the ionization has occurred is thus available.

Figure 3:
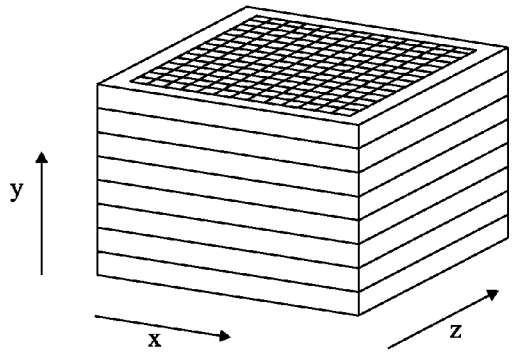
FIG. 3 is a diagram specifying the coordinate axes used in the present description.

For the orientation of axes x, y, and z, reference will be made to FIG. 3, which very schematically shows a detector assembly. This detector assembly comprises transverse slices vertically stacked in the y direction, axis x designating the horizontal direction, and axis z designating the direction in which the ionizing radiation is likely to arrive.

Thus, with circuits 16 and 18, it can be accurately determined the cell **12-*ijk*** at which the conversion of a radiation, for example, of a neutron, has occurred.

The structure is arranged in a housing filled with a gas capable of being ionized, as is conventional. The gas is, for example, pressurized. On the other hand, the conversion product reacting with the ionizing radiation (for example, neutrons) may be, as in the previously-described prior art, a gas such as helium-3 or $BF_3$. It may also be a reactive material deposited in a thin layer, alone or in combination with another material, on the walls of each tube, or even the combination of helium-3 or $BF_3$ and of thin layers of a reactive material. This reactive material may be boron-10, capable of interacting with a neutron to provide lithium-7 and an alpha-4 particle. Other products that may be used are known in the art. These may, for instance, be gadolinium or lithium isotopes, such materials being deposited in thin layers on the tube walls and/or on the central conductive strip 14-1, 14-2, . . . , **14-*n***. Using such conversion materials is advantageous since helium 3 is extremely expensive and difficult to obtain. Advantageously, the use of the gas $BF_3$ and a coating of boron on the walls of each tube leads to a double effect for the detection of neutrons. However, it is very difficult to coat the internal walls of a tube with a layer containing such a material.

The structure provided herein enables, as will be seen hereafter, to very simply achieve the wall coating.

Figure 4:
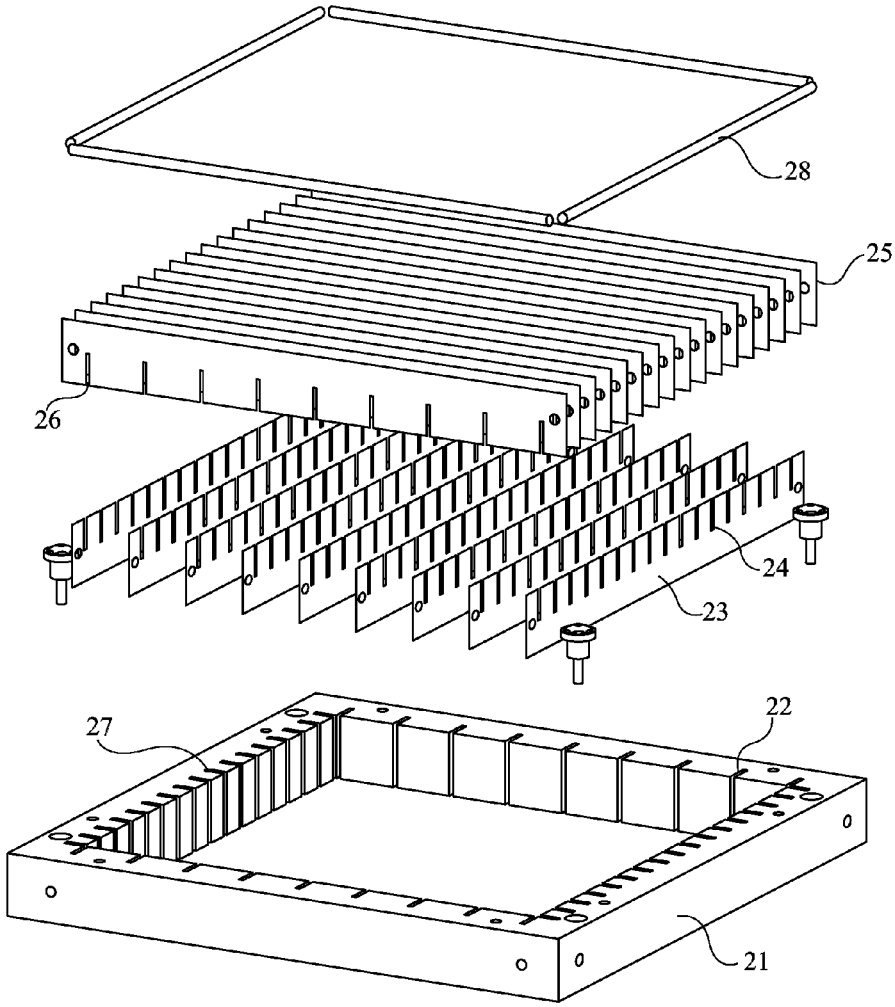
FIG. 4 illustrates an embodiment of an element of a detector according to an embodiment of the present invention.

FIG. 4 is an exploded view of an embodiment of a horizontal or transverse slice (arranged between two neighboring horizontal planes), which comprises a section of each of the tubes of a detector according to an embodiment of the present invention. The wafer is formed from a frame 21 having opposite edges provided with grooves 22 intended to receive first plates or blades 23 oriented in direction z (of FIG. 3). Plates 23 are provided with slots 24 into which orthogonal plates or blades 25 provided with slots 26 cooperating with slots 24 are intended to fit. The ends of plates 25 are received in opposing slots 27 of the frame edges oriented along direction z (of FIG. 3). The contact between plates 23, 25 and frame 21 and between the plates is conductive. The assembly of cells or sections of a horizontal slice (a grid) of the detector is thus obtained.

It should be noted that plates, or blades, 23 and 25 can easily be coated with a conversion product before their assembly, which greatly simplifies this coating or deposition. Thus, when an ionizing radiation interacts at the level of one of the cells, there results an electric signal on the central conductor 14-1, 14-2, . . . , **14-*n* and on the slice. FIG. 4 also shows a seal 28** intended to separate two slices of a detector according to some embodiments of the present invention.

It should be understood that this is only an embodiment of the present invention. Any honeycomb structure, for example, comprising cells of hexagonal or other shapes, may be used. Furthermore, it should be noted that the frame 21 having slots 22 and 27 is optional. Alternatively, a stack of the plates 23 and 25 could be fixed in a chamber, as will be described in more detail below.

It has been indicated hereabove that any section and any wire crossing an assembly of vertically-aligned sections are connected to a biasing and detection system so that the wires form anodes and the walls of the sections of a slice form cathodes enabling to attract the ionized gases generated by the conversion of the ionizing bombarding. It has also been indicated that each wire and each cell slice is connected by a separate conductive wire to be able to recognize the cell where the ionizing radiation has been converted. Actually, this cell discrimination is not always necessary. In certain cases, it is only desired, for example in airport security devices, to know whether a piece of luggage or a container contains neutron-emitting radioactive products. It will then be sufficient to connect all of the wires together and all of the sections together to have a device with few output lines and that is very simple to use.

As an example of dimensions, each section may have a side length in the order of 2 centimeters (cm) and a height in the order of 2 cm and the entire structure may have a height in the order of 3 meters (m). It will be within the abilities of those skilled in the art to adapt these dimensions to their needs.

An advantage of the use of such a grid structure is that the cross-section of each tube may have small dimensions. For example, rather than being equal to 2 cm as described below, the side length of each section of each rectangular tube is for example as low as between 4 and 10 millimeters (mm). This allows a low time of flight of electrons resulting from a reaction, and therefore a relatively high pressure of the gas can be used in the tube, for example greater than $2\times10^5$ pascals. This is particularly beneficial when the gas is $BF_3$. Furthermore, such a grid structure may advantageously be formed of plates 23, 25 of aluminum, for example having a thickness of 0.5 mm or less.

Figure 5:
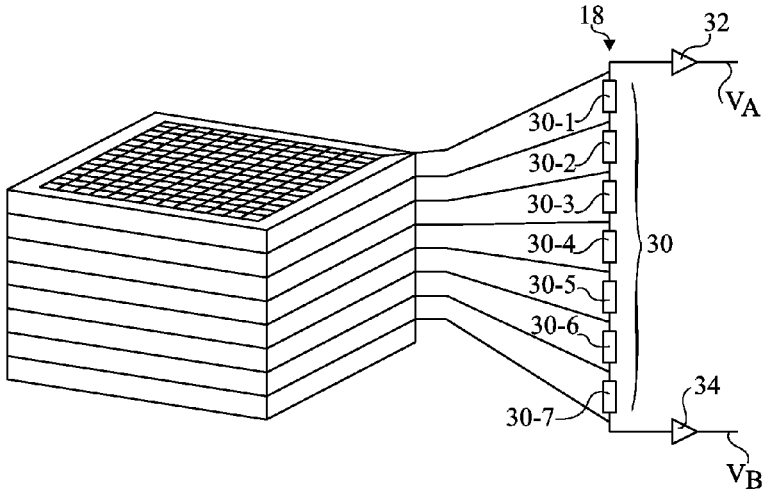
FIG. 5 illustrates a radiation detector in more detail according to an embodiment of the present invention.

FIG. 5 illustrates the radiation detector in more detail, and in particular an example of detection circuitry of the biasing and detection device 18. The detection circuitry comprises a resistor network 30 comprising a series of resistors 30-1 to 30-7 coupled in series. Each resistor, for example, has a resistance of between 100 and 200 ohms. In this example there are 8 slices and 7 resistors, and a connection from the grid of each slice is coupled to the connection of a neighboring grid by a corresponding resistor. The two ends of the resistor network are coupled to amplifiers 32 and 34 respectively, which provide respective output voltages $V_A$ and $V_B$. Based on these voltages, the slice in which a radiation is detected can be identified. In particular, the position is indicated by calculating $V_A/(V_A+V_B)$.

An advantage of using the resistor network 30 of FIG. 5 is that it reduces the number of output lines to two, rather than being equal to the number of slices.

Figure 6:
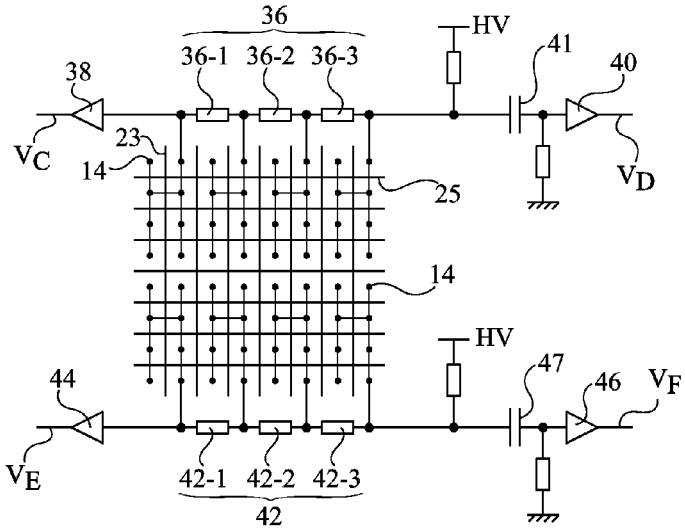
FIG. 6 schematically illustrates in plan view a top slice of the radiation detector of FIG. 5 in more detail according to an embodiment of the present invention.

FIG. 6 illustrates in plan view the top slice of the radiation detector, and shows the biasing and detection circuitry 16 according to one example in which groups of the conducting wires 14 of each tube are coupled together. In the particular example of FIG. 6, the wires of blocks of tubes four deep and two wide are coupled together, although other block shapes and sizes could be chosen. This further reduces the number of output lines from the radiation detector.

Additionally or alternatively, one or more resistive networks can be used to reduce the number of connections to the wires. FIG. 6 show the example of a resistance network 36 having three series connected resistors 36-1 to 36-3, and amplifiers 38 and 40 at each end providing voltages $V_C$ and $V_D$. Corresponding nodes of the resistor network 36 are coupled to four of the groups of interconnected wires 14. The biasing circuitry for applying a biasing voltage to these wires 14 is also shown, which, for example, comprises a high voltage supply HV coupled via a resistor to the end of the resistor network, on the side of amplifier 40. A capacitor 41 is coupled between the resistance network and the amplifier 40, while the input of amplifier 40 is further coupled via a resistor to ground. Similarly, FIG. 6 illustrates an example of a resistance network 42 having three series connected resistors 42-1 to 42-3, and amplifiers 44 and 46 at each end providing voltages $V_E$ and $V_F$. Corresponding nodes of the resistor network 42 are coupled to four of the groups of interconnected wires 14. The biasing circuitry for applying a biasing voltage to these wires 14 is also shown, which, for example, comprises a high voltage supply coupled via a resistor to the end of the resistor network, on the side of amplifier 46. A capacitor 47 is coupled between the resistance network and the amplifier 46, while the input of amplifier 47 is further coupled via a resistor to ground.

Figure 7:
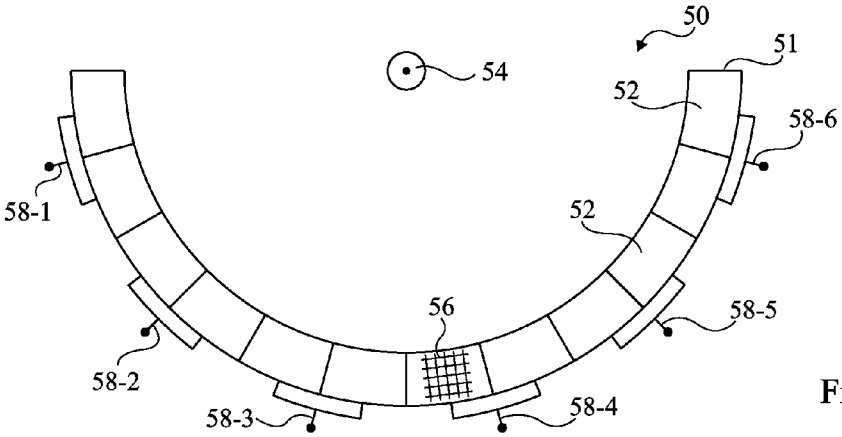
FIG. 7 illustrates a radiation detection apparatus according to an embodiment of the present invention.

FIG. 7 illustrates, in plan view, a radiation detection apparatus 50 comprising a curved wall 51 formed of a series of chambers 52, each of which contains the pressurized gas of the detectors. The wall 51 is, for example, formed of metal sheets having a thickness in the region of 3 mm. Each chamber 52 comprises a radiation detector as described above, of which one example 56 is illustrated.

In one embodiment, the slices of the same level in neighboring detectors are coupled together, for example, in pairs, to provide combined outputs, one level of such outputs being shown labeled 58-1 to 58-6 in FIG. 7. This further reduces the number of output lines.

Such an apparatus can be used in scientific applications, to detect the direction of radiation originating from a source 54 at the center of a partial cylinder formed by the curved wall 51.

Specific embodiments of the present invention have been described. Various alterations and modifications will occur to those skilled in the art. In particular, the superposed slices may define various cell shapes and be formed in various ways.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. An ionizing radiation detector comprising:

a plurality of conductive tubes arranged in parallel containing a gas mixture, and a conductive wire pulled tight at the center of each of said plurality of conductive tubes and capable of being biased with respect thereto, wherein each of said plurality of tubes is divided into electrically isolated longitudinal sections, all the tube sections of a same transverse slice being formed of a grid of electrically connected blades and each group of sections of a same slice comprising means for being connected to a first detection circuit.

2. The detector of claim 1, wherein said grid of blades of each slice is connected to a frame.

3. The detector of claim 1, wherein each blade is coated with a layer containing a radiation conversion product configured for generating ions as a response to an ionizing radiation.

4. The detector of claim 3, wherein the conversion product is boron-10.

5. The detector of claim 1, wherein said gas mixture is a pressurized gas mixture comprising $BF_3$.

6. The detector of claim 1, wherein said blades are formed of aluminum.

7. The detector of claim 1, wherein said first detection circuit comprises a first plurality of resistors coupled in series between first and second amplifiers, the nodes between said resistors being coupled to the connection means of respective slices.

8. The detector of claim 1, wherein each of said tubes comprises means for connecting the conductive wire of said tube to a second detection circuit.

9. The detector of claim 8, wherein the conductive wires of a group of said plurality of tubes are coupled together.

10. The detector of claim 8, wherein said second detection circuit comprises a second plurality of resistors coupled in series between third and fourth amplifiers, the nodes between said resistors being coupled to the connection means of respective tubes or groups of tubes.

11. The detector of claim 1, wherein the detector is configured to detect neutrons.

12. An ionizing radiation detector comprising:

a plurality of conductive tubes arranged in parallel containing a gas mixture, and a conductive wire pulled tight at the center of each of said plurality of conductive tubes and capable of being biased with respect thereto, wherein each of said plurality of tubes is divided into electrically isolated longitudinal sections, all the tube sections of a same transverse slice being formed of a grid of electrically connected blades and each group of sections of a same slice comprising means for being connected to a first detection circuit, and wherein a first group of blades of said grid comprises a first plurality of slots which are configured to cooperate with a second plurality of slots of a second group of blades of said grid, said second group of blades being orthogonal with respect to said first group of blades.

13. The detector of claim 12, wherein each blade of said first and second groups of blades includes a first end and a second end opposite the first end, defining a length of said blade, the first end being connected to a first portion of a frame, and the second end being connected to a second portion of the frame, each blade further comprising a plurality of slots extending a given depth from an edge of the blade and disposed along the length of the blade.

14. The detector of claim 13, wherein the frame includes a plurality of grooves configured to receive corresponding ends of said first and second groups of blades.

15. An apparatus for detecting ionizing radiation comprising a plurality of the detectors positioned side by side, each of the plurality of detectors comprising:

a plurality of conductive tubes arranged in parallel containing a gas mixture, and a conductive wire pulled tight at the center of each of said plurality of conductive tubes and capable of being biased with respect thereto, wherein each of said plurality of tubes is divided into electrically isolated longitudinal sections, all the tube sections of a same transverse slice being formed of a grid of electrically connected blades and each group of sections of a same slice comprising means for being connected to a detection circuit.

16. The apparatus of claim 15, wherein said plurality of detectors are each positioned in a corresponding one of a series of chambers forming a segment of a cylinder.

* * * * *